US009223260B2

(12) United States Patent
Nishinoue et al.

(10) Patent No.: US 9,223,260 B2
(45) Date of Patent: Dec. 29, 2015

(54) IMAGE FORMING APPARATUS AND FIXING DEVICE

(71) Applicant: Konica Minolta, Inc., Tokyo (JP)

(72) Inventors: Kazunori Nishinoue, Tokyo (JP); Miho Yamano, Tokyo (JP); Makoto Fujii, Tokyo (JP); Hiroshi Matsumoto, Tokyo (JP); Taizou Oonishi, Tokyo (JP); Atsushi Nakamura, Tokyo (JP)

(73) Assignee: KONICA MINOLTA, INC., Toyko (JP)

( * ) Notice: Subject to any disclaimer, the term of this patent is extended or adjusted under 35 U.S.C. 154(b) by 0 days.

(21) Appl. No.: 14/541,773

(22) Filed: Nov. 14, 2014

(65) Prior Publication Data

US 2015/0185669 A1 Jul. 2, 2015

(30) Foreign Application Priority Data

Dec. 27, 2013 (JP) ..... 2013-272335

(51) Int. Cl.

*G03G 15/00* (2006.01)
*G03G 15/20* (2006.01)
*G03G 21/00* (2006.01)

(52) U.S. Cl.

CPC ..... *G03G 15/2017* (2013.01); *G03G 15/2064* (2013.01); *G03G 15/6573* (2013.01); *G03G 2215/00649* (2013.01); *G03G 2215/2032* (2013.01)

(58) Field of Classification Search

CPC ..... G03G 15/2017; G03G 15/50; G03G 15/5029; G03G 15/5062; G03G 15/6573; G03G 15/6579; G03G 15/6588; G03G 15/6594; G03G 21/00; G03G 2215/00421; G03G 2215/00426; G03G 2215/2083; G03G 15/2064; G03G 2215/00649; G03G 2215/2032

USPC ..... 399/67, 15, 45, 401, 341

See application file for complete search history.

(56) References Cited

U.S. PATENT DOCUMENTS

| | | | | |
|---|---|---|---|---|
| 7,352,987 | B2 * | 4/2008 | Iwata et al. | 399/329 |
| 7,596,333 | B2 * | 9/2009 | Kasiske et al. | 399/67 |
| 2004/0091279 | A1 * | 5/2004 | Izawa et al. | 399/67 |
| 2005/0111890 | A1 * | 5/2005 | Hasenauer et al. | 399/315 |
| 2006/0244804 | A1 | 11/2006 | Ono et al. | |

FOREIGN PATENT DOCUMENTS

| | | | |
|---|---|---|---|
| JP | 60-029763 | A | 2/1985 |
| JP | 62-121169 | A | 6/1987 |
| JP | 04-199174 | A | 7/1992 |
| JP | 10-302993 | A | 11/1998 |
| JP | 11-073044 | A | 3/1999 |
| JP | 2006-044907 | A | 2/2006 |
| JP | 2006-306559 | A | 11/2006 |
| JP | 2011-232439 | A * | 11/2011 |
| JP | 2013-003363 | A * | 1/2013 |

* cited by examiner

*Primary Examiner* — Sophia S Chen
(74) *Attorney, Agent, or Firm* — Lucas & Mercanti, LLP

(57) ABSTRACT

An image forming apparatus includes a fixing side member disposed at a position on a fixing surface side of a sheet on which a toner image is formed; a back side supporting member that forms a fixing nip for conveying the sheet in a tightly sandwiching manner when the back side supporting member is in pressure contact with the fixing side member; and a voltage applying section that applies to both sides of the sheet passed through the fixing nip voltages opposite in polarity to surface potentials of the both sides.

15 Claims, 5 Drawing Sheets

| BASIS WEIGHT OF SHEET[gsm] | SURFACE POTENTIAL[kV] |
|---|---|
| 157 | −2.5 |
| 186 | −4.0 |
| 256 | −5.0 |

FIG.5

IMAGE FORMING APPARATUS AND FIXING DEVICE

CROSS REFERENCE TO RELATED APPLICATIONS

This application is entitled and claims the benefit of Japanese Patent Application No. 2013-272335, filed on Dec. 27, 2013, the disclosure of which including the specification, drawings and abstract is incorporated herein by reference in its entirety.

BACKGROUND OF THE INVENTION

1. Field of the Invention

The present invention relates to an image forming apparatus and a fixing device.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to a sheet, followed by heating and pressurization, whereby an image is formed on the sheet.

The above-mentioned image forming apparatus has a problem that the amount of charge of sheets is increased due to the increased speed, increased frequency of duplex printing, and improved image quality, and as a result, the sheets after the fixing step are electrostatically attached to each other. Typically, sheets are charged at a transferring step and a fixing step. In the transferring step, a high voltage is applied to the sheet to electrostatically attach (transfer) a toner image to the sheet. Here, as the basis weight of a sheet is increased, the required amount of voltage is increased, and the surface potential (charging potential) of the sheet is increased. In addition, in the fixing step, a sheet is conveyed while being heated and pressed at the fixing nip, and therefore the sheet is charged by the frictional charge generated between the sheet and the fixing member, and by the peeling charge generated by the peeling of the sheet from the fixing member peel. When sheets after the fixing step are electrostatically attached to each other, the sheets are difficult to align at the time of placing the sheets in a placement tray or the like before aligning the sheets and performing a post process such as a cutting process and a punching process, and this may result in a negative influence on the result of the post processes.

In order to solve the above-mentioned problem, an image forming apparatus has been proposed in which a first discharging brush is provided in a sheet width range except for the portion where an ejection roller is disposed at a sheet outlet, and a second discharging brush is provided in a range of the width of the ejection roller on the downstream side relative to the sheet outlet of the sheet conveyance path (see, for example, Japanese Patent Application Laid-Open No. 10-302993).

In addition, an image forming apparatus has been proposed which includes a first discharger provided in the proximity of a portion on the downstream side of the sheet ejection roller pair, a second discharger provided at an entrance of a sheet guide disposed on the downstream of the first discharger, and a third discharger provided in the proximity of the a portion on the upstream side of the sheet ejection roller pair (see, for example, Japanese Patent Application Laid-Open No. 2006-44907).

In addition, an image forming apparatus has been proposed which includes a sheet pressing member provided with three functions including a function of enhancing the placement of sheet members by guiding the sheet members onto an ejection tray, a function as a detection member for detecting the amount of placed sheet members, and a function of discharging the sheet members (see, for example, Japanese Patent Application Laid-Open No. 2006-306559).

However, in the techniques disclosed in Japanese Patent Application Laid-Open Nos. 10-302993, 2006-44907 and 2006-306559, since only one side of the sheet is neutralized, the electric charge of the sheet cannot be sufficiently removed. That is, the technique disclosed in Japanese Patent Application Laid-Open Nos. 10-302993, 2006-44907 and 2006-306559 cannot sufficiently solve the problem that the sheets after the fixing step are electrostatically attached to each other.

SUMMARY OF THE INVENTION

An object of the present invention is to provide a fixing device and an image forming apparatus which can prevent the sheets after the fixing step from being electrostatically attached to each other.

To achieve the abovementioned object, an image forming apparatus reflecting one aspect of the present invention includes a fixing side member disposed at a position on a fixing surface side of a sheet on which a toner image is formed; a back side supporting member that forms a fixing nip for conveying the sheet in a tightly sandwiching manner when the back side supporting member is in pressure contact with the fixing side member; and a voltage applying section that applies to both sides of the sheet passed through the fixing nip voltages opposite in polarity to surface potentials of the both sides.

Desirably, the image forming apparatus further includes a surface potential detection section that detects surface potentials of the both sides, in which the voltage applying section applies a voltage to the sheet so as to cancel out the surface potentials detected by the surface potential detection section.

Desirably, the voltage applying section changes a voltage to be applied to the sheet in accordance with coverage of the toner image formed on the sheet.

Desirably, the voltage applying section increases the value of the voltage to be applied to the sheet as the coverage of the toner image formed on the sheet increases.

Desirably, the voltage applying section changes a voltage to be applied to the sheet in accordance with a resistance of the sheet.

Desirably, the voltage applying section increases the value of the voltage to be applied to the sheet as the resistance of the sheet increases.

Desirably, the voltage applying section changes a voltage to be applied to the sheet in accordance with a basis weight of the sheet.

Desirably, the voltage applying section increases the value of the voltage to be applied to the sheet as the basis weight of the sheet increases.

Desirably, the voltage applying section changes a voltage to be applied to the sheet according to whether one-side printing for forming a toner image on one side of the sheet or duplex printing for forming a toner image on both sides of the sheet is performed.

Desirably, the voltage applying section sets a value of a voltage to be applied to the sheet during the duplex printing to a value larger than a value of a voltage to be applied to the sheet during the one-side printing.

Desirably, the voltage applying section applies to each sheet passed through the fixing nip voltages opposite in polarity to the surface potentials of the both sides.

Desirably, the voltage applying section determines whether to apply voltages opposite in polarity to the surface potentials of the both sides on printing job basis.

Desirably, the voltage applying section applies a voltage to the sheet by making contact with the both sides of the sheet passed through the fixing nip.

Desirably, the voltage applying section applies a voltage to the sheet without making contact with either side of the sheet passed through the fixing nip.

Desirably, the voltage applying section applies voltages to the both sides of the sheet passed through the fixing nip, the voltages applied to the both sides being different from each other in polarity.

A fixing device reflecting another aspect of the present invention includes: a fixing side member disposed at a position on a fixing surface side of a sheet on which a toner image is formed; a back side supporting member that forms a fixing nip for conveying the sheet in a tightly sandwiching manner when the back side supporting member is in pressure contact with the fixing side member; and a voltage applying section that applies to both sides of the sheet passed through the fixing nip voltages opposite in polarity to surface potentials of the both sides.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 5 illustrates a relationship between a basis weight of a sheet and a potential of a surface of the sheet.

DESCRIPTION OF THE PREFERRED EMBODIMENTS

Figure 1:
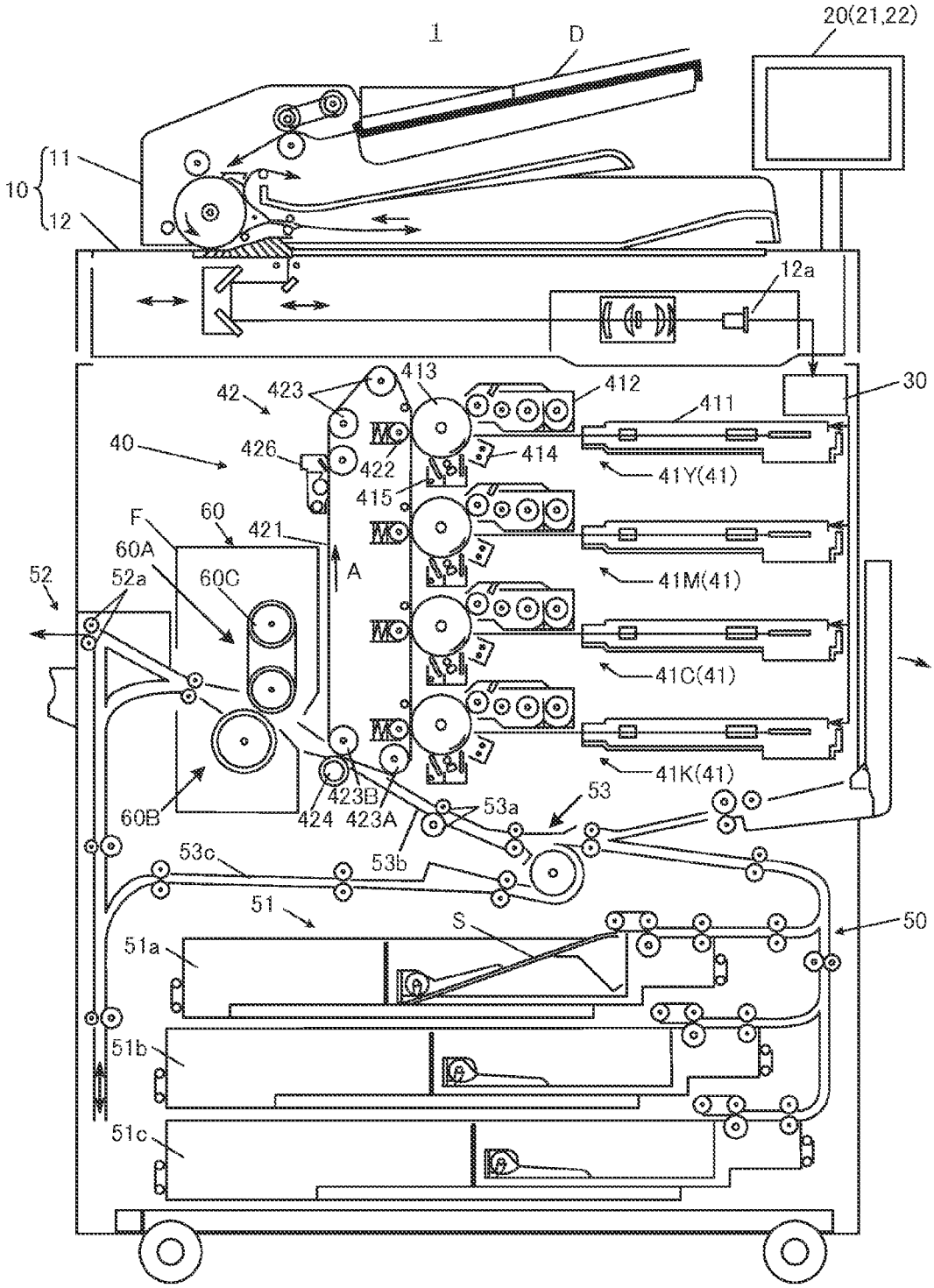
FIG. 1 schematically illustrates a general configuration of an image forming apparatus according to the present embodiment.
Figure 2:
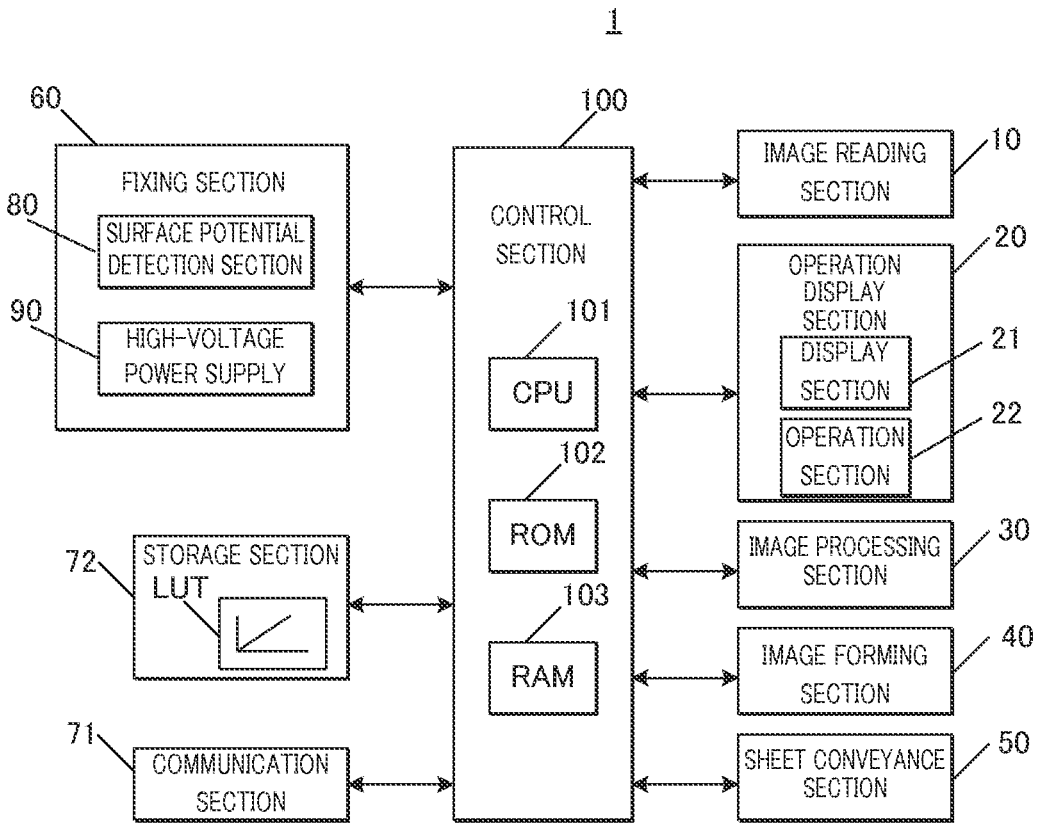
FIG. 2 illustrates a principal part of a control system the image forming apparatus according to the present embodiment.

In the following, an embodiment is described in detail with reference to the drawings. FIG. 1 illustrates an overall configuration of image forming apparatus 1 according to the embodiment of the present invention. FIG. 2 illustrates a principal part of a control system of image forming apparatus 1 according to the embodiment. Image forming apparatus 1 illustrated in FIGS. 1 and 2 is a color image forming apparatus with an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to sheet S, to thereby form an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 1 includes image reading section 10, operation display section 20, image processing section 30, image forming section 40, sheet conveyance section 50, fixing section 60 (which corresponds to "fixing device" of the embodiment of the present invention), and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanner (scanner) 12, and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

Image processing section 30 includes a circuit that performs digital image processing suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K for images of colored toners respectively containing a Y component, an M component, a C component, and a K component on the basis of the input image data; intermediate transfer unit 42; and the like.

Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drums 413 are, for example, negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm]. The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drums 413, whereby photoconductor drums 413 is rotated at a constant circumferential speed.

Charging device 414 generates a corona discharge to evenly and negatively charge the photoconductive surface of photoconductor drum 413.

Exposure device 411 is composed of, for example, a semiconductor laser, and configured to irradiate photoconductor drum 413 with laser light corresponding to the image of each color component. Since the positive charge is generated in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in an arrow A direction at a constant speed.

Intermediate transfer belt 421 is a belt having conductivity and elasticity which includes on the surface thereof a high resistance layer having a volume resistivity of 8 to 11 [ log Ω·cm]. Intermediate transfer belt 421 is rotationally driven by a control signal from control section 100. It is to be noted that the material, thickness and hardness of intermediate transfer belt 421 are not limited as long as intermediate transfer belt 421 has conductivity and elasticity.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face roller 423B (hereinafter referred to as "backup roller 423B") disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and electric charge of the polarity opposite to the polarity of the toner is applied to the rear side (the side that makes contact with secondary transfer roller 424) of sheet S, whereby the toner image is electrostatically transferred to sheet S. Sheet S on which the toner images have been transferred is conveyed toward fixing section 60.

Belt cleaning device 426 removes the residual transfer toner remaining on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) of sheet S, lower fixing section 60B having a back side supporting member disposed on the rear surface (the surface opposite to the fixing surface) side of sheet S, heating source 60C, and the like. Back side supporting member is brought into pressure contact with the fixing side member, whereby a fixing nip for conveying sheet S in a tightly sandwiching manner is formed.

Fixing section 60 applies, at the fixing nip, heat and pressure to sheet S on which a toner image has been secondary-transferred, thereby fixing the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of conveyance roller pairs including registration rollers pair 53*a*, normal conveyance path 53*b* that conveys sheet S through image forming section 40 and fixing section 60 and ejects sheet S to a paper tray (not illustrated) of image forming apparatus 1, and inversion conveyance path 53*c* that invers sheet S having passed through fixing section 60 and thereafter conveys sheet S again into normal conveyance path 53*b* on the upstream of image forming section 40. In the case of duplex printing, a toner image is formed on the front surface (first surface) of sheet S when sheet S passes through first normal conveyance path 53*b*, and a toner image is formed on the rear surface (second surface) of sheet S when sheet S passes through normal conveyance path 53*b* after passing through invert conveyance path 53*c*.

The recording sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet discharging rollers 52*a*.

Figure 3:
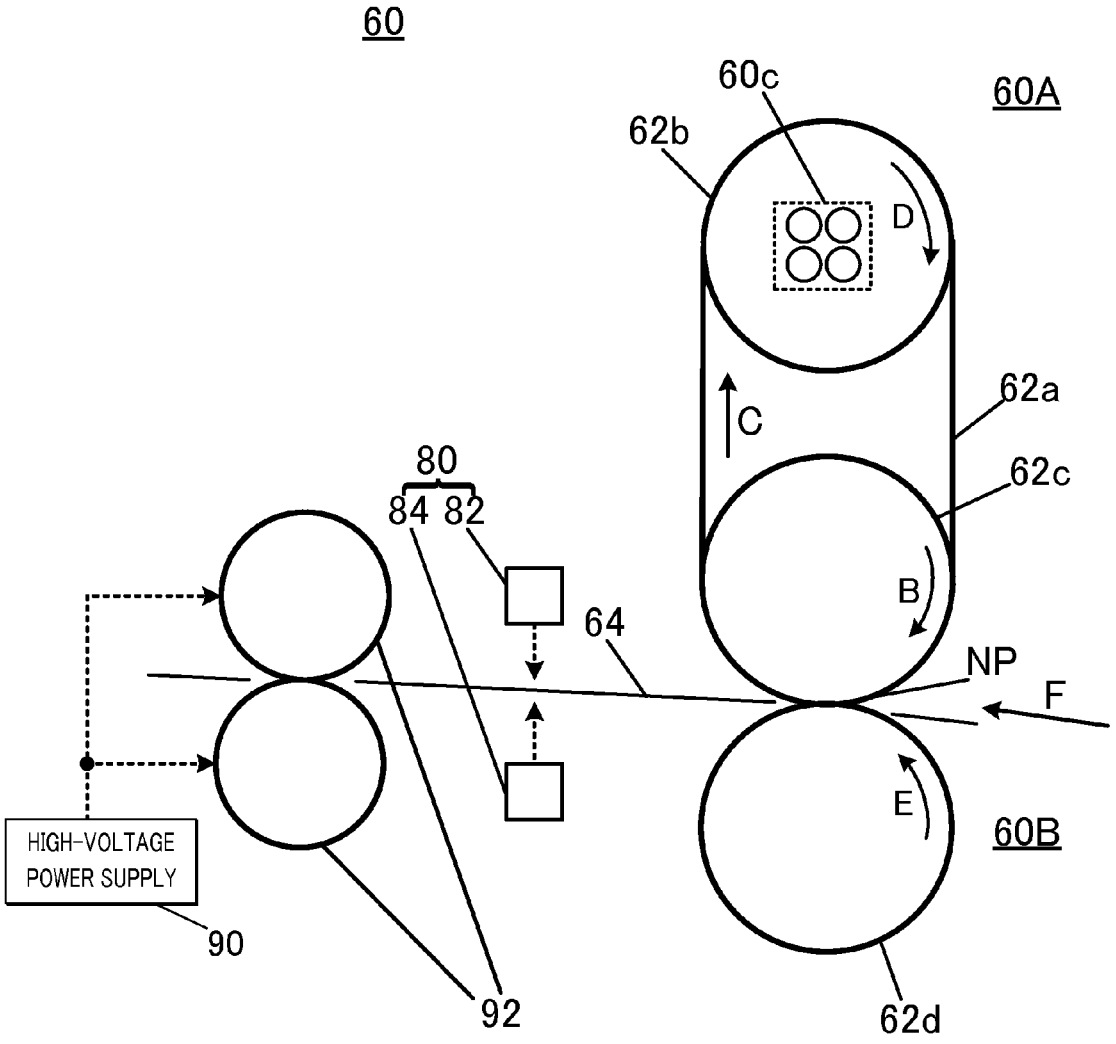
FIG. 3 illustrates a configuration of a fixing section according to the present embodiment.

Next, with reference to FIG. 3, the configuration of fixing section 60 will be described. FIG. 3 is a schematic view illustrating the configuration of fixing section 60.

Upper side fixing section 60A includes endless fixing belt 62*a*, heating roller 62*b* and fixing roller 62*c*, which serve as a fixing side member (belt heating system). Fixing belt 62*a* is installed in a stretched state around heating roller 62*b* and fixing roller 62*c* at a predetermined belt tensile force (for example, 40 [N]).

Fixing belt 62*a* has a configuration in which, for example, the outer peripheral surface of a 70 [μm]-thick base member made of PI (polyimide) is covered by a 200 [μm]-thick heat-resistant silicone rubber (hardness JIS-A 30[°]) serving as an elastic layer, and further, a 30 [μm]-thick tube made of PFA (perfluoro alkoxy), which is a heat-resistant resin, is provided on the surface layer. Together with pressure roller 62*d*, fixing belt 62*a* forms fixing nip NP.

Fixing belt 62*a* makes contact with sheet S on which toner image is formed, so as to thermally fix the toner image on sheet S at a fixing temperature (for example, 160 to 200[° C.]). The fixing temperature is a temperature at which a heat energy required for melting the toner on sheet S can be obtained, and the fixing temperature differs depending on factors such as the type of sheet S on which an image is to be formed.

Heating roller 62*b* applies heat to fixing belt 62*a*. Heating roller 62*b* is provided therein with heating source 60C (halogen heater) for applying heat to fixing belt 62. Heating roller 62*b* has a configuration in which the outer peripheral surface of a cylindrical mandrel made of aluminum or the like is coated with a resin layer of PTFE, for example.

The temperature of heating source 60C is controlled by control section 100. Heating source 60C applies heat to heating roller 62*b*, and as a result, fixing belt 62*a* is heated.

Fixing roller 62*c* has a configuration in which, for example, a solid mandrel made of a metal such as iron is covered with a 10 to 20 [mm]-thick heat-resistant silicone rubber (hardness JIS-A 5 to 30[°]) as an elastic layer, and is further coated with a 5 to 30 [μm]-thick resin layer of PTFE, which is a low-friction and heat-resistant resin.

Lower side fixing section 60B includes pressure roller 62*d* serving as a back side supporting member (roller pressing type). Pressure roller 62*d* has a configuration in which the outer peripheral surface of a cylindrical mandrel made of aluminum or the like is covered with a 1 to 5 [mm]-thick heat-resistant silicon rubber (hardness: JIS-A30[°]) as an elastic layer, and is further covered with a 30 to 100 [μ]-thick resin layer of a PFA tube. Pressure roller 62*d* is driven and controlled (for example, on/off of rotation, rotation speed, and the like) by control section 100. Control section 100 rotates pressure roller 62*d* an arrow E direction (counter-clockwise direction). When pressure roller 62*d* is rotated, fixing belt 62*a* rotates in an arrow C direction (clockwise direction) to follow the rotation of lower pressure roller 62*d*. Along with this rotation, fixing roller 62*c* and heating roller 62*b* rotate in an arrow B direction (clockwise direction) and an arrow D direction (clockwise direction), respectively. Pressure roller 62*d* is brought into pressure contact with fixing roller 62*c* fixing belt 62*a* with therebetween at a predetermined fixing load (for example, 1000 [N]). Thus, fixing nip NP for conveying sheet S in a tightly sandwiching manner is formed between fixing belt 62*a* and pressure roller 62*d*.

In the present embodiment, as illustrated in FIG. 3, surface potential detection section 80 and conveyance roller pair 92 serving as a voltage applying member are provided on the downstream side of fixing nip NP relative to conveyance direction F of sheet S. Surface potential detection section 80 includes potential detection sensors 82 and 84, and detects potential values of the both sides (upper surface and lower surface) of sheet S which has passed through fixing nip NP and is conveyed on sheet guide 64. Potential detection sensor 82 detects a potential value on the upper surface of sheet S in a noncontact manner, and outputs to control section 100 a signal representing the detected potential value. Potential detection sensor 84 detects a potential value on the lower surface of sheet S in a noncontact manner, and outputs to control section 100 a signal representing the detected potential value.

Conveyance roller pair 92 is a conveyance roller pair for conveying sheet S to paper ejection section 52 side, and conveyance roller pair 92 is connected with high-voltage power supply 90 that applies a voltage to each of conveyance roller pair 92 upon reception of a control signal from control section 100. During the image formation process of image forming apparatus 1, high-voltage power supply 90 applies, to the both sides of sheet S having passed through fixing nip NP, voltages opposite in polarity to the surface potentials of the both sides through conveyance roller pair 92. In the present embodiment, high-voltage power supply 90 applies to the both sides of sheet S voltages opposite in polarity to the surface potentials of the both sides so as to cancel out the surface potentials detected by surface potential detection section 80. It is to be noted that high-voltage power supply 90 and conveyance roller pair 92 correspond to "voltage applying section" of the embodiment of the present invention. As high-voltage power supply 90, a high-voltage power supply for a primary transfer and a secondary transfer may be utilized.

Figure 4:
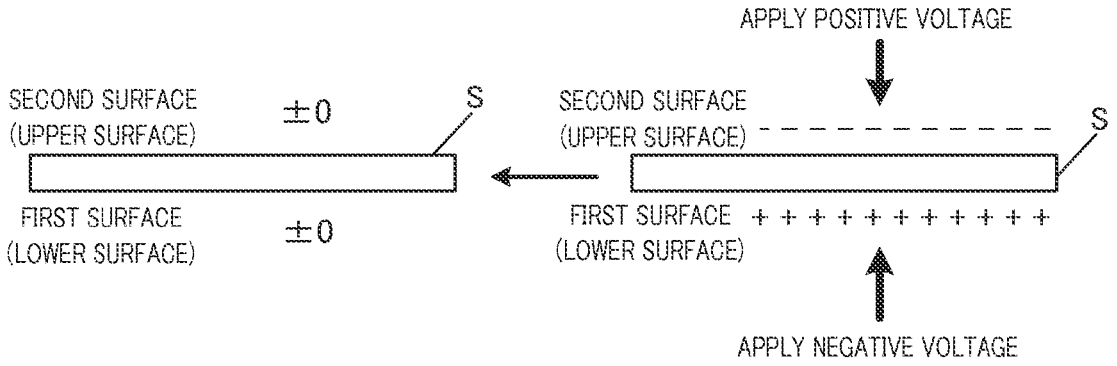
FIG. 4 illustrates a state where a voltage is applied to both sides of a sheet.

FIG. 4 illustrates a state where high-voltage power supply 90 applies, through conveyance roller pair 92, voltages to the both sides of sheet S having passed through fixing nip NP during an image formation process of image forming apparatus 1 (to be more specific, at the time of printing on the second surface in a duplex printing process for forming images on both sides of sheet S). As illustrated in FIG. 4, the upper surface (second surface of the duplex printing) of sheet S is negatively charged, and the lower surface (first surface of the duplex printing) of sheet S is positively charged. High-voltage power supply 90 applies to the lower surface of sheet S a voltage (minus polarity) opposite to the surface potential of the lower surface, so as to cancel out the surface potential (plus polarity) of the lower surface (first surface) of sheet S. In addition, high-voltage power supply 90 applies to the upper surface of sheet S a voltage (plus polarity) opposite to the surface potential of the upper surface, so as to cancel out the surface potential (minus polarity) of the upper surface (second surface) of sheet S. As a result, the surface potential of the both sides (upper surface and lower surface) of sheet S is set to about ±0 [V], and thus, it is possible to surely prevent the sheets S after the fixing step from being electrostatically attached to each other.

As has been described in detail, in the present embodiment, image forming apparatus 1 (fixing section 60) includes: a fixing side member (fixing belt 62*a*, heating roller 62*b* and fixing roller 62*c*) disposed at a position on a fixing surface side of a sheet on which a toner image is formed; a back side supporting member (pressure roller 62*d*) that forms a fixing nip for conveying the sheet in a tightly sandwiching manner when the back side supporting member is in pressure contact with the fixing side member; and a voltage applying section (high-voltage power supply 90 and conveyance roller pair 92) that applies to both sides of the sheet passed through fixing nip NP voltages opposite in polarity to surface potentials of the both sides.

According to the above-mentioned configuration of the present embodiment, voltages opposite in polarity to the surface potentials of the both sides of sheet S having passed through fixing nip NP are applied to the both sides of sheet S, the electric charge of the both sides of sheet S is sufficiently removed in comparison with the case where only one side is neutralized. Therefore, it is possible to prevent the sheets S after the fixing step from being electrostatically attached to each other. Sheets S are not difficult to align sheets S in a placement tray or the like before aligning sheets S and performing post processing such as a cutting process and a punching process, and thus a negative influence on the result of the post processes can be prevented.

It is to be noted that, while conveyance roller pair 92 is brought into contact with sheet S to apply a voltage to the both sides of sheet S in the above-mentioned embodiment, the present invention is not limited to this. For example, in place of conveyance roller pair 92, brush may be brought into contact with the both sides of sheet S to apply a voltage to the both sides of sheet S. It is also possible to apply a voltage to the both sides of sheet S in a noncontact manner by corona discharge using a needle electrode or a wire.

In addition, in the above-mentioned embodiment, the voltage applied to the both sides of sheet S may be changed in accordance with the coverage of the toner image formed on sheet S. In this case, as the coverage of the toner image formed on sheet S increases, the toner charge amount on sheet S increases and the surface potential of sheet S increases, and therefore, it is preferable to increase the value of the voltage applied to the both sides of sheet S.

In addition, in the above-mentioned embodiment, the voltage applied to the both sides of sheet S may be changed in accordance with the resistance of sheet S. In this case, as the resistance of sheet S increases, sheet S is charged more easily, and the surface potential of sheet S increases. For this reason, it is preferable that the voltage applied to the both sides of sheet S be increased as the resistance of sheet S increases.

In addition, in the above-mentioned embodiment, the voltage applied to the both sides of sheet S may be changed in accordance with the basis weight of sheet S. FIG. 5 is a chart showing relationships between the basis weight of sheet S and the surface potential of the sheet S during a duplex printing process in which a high-coverage toner image is formed on the both sides of sheet S (for example, gloss coat paper). As illustrated in FIG. 5, as the basis weight of sheet S increases, the required value of the voltage to be applied to sheet S increases and the surface potentials of the both sides of sheet S increase, and therefore, it is preferable to increase the voltage applied to the both sides of sheet S.

In addition, in the above-mentioned embodiment, the voltage applied to the both sides of sheet S may be changed according to whether one-side printing for forming a toner image on one side of sheet S, or duplex printing for forming a toner image on both sides of sheet S is performed. Unlike the case of the one-side printing, in the case of the duplex printing, a toner image is formed on sheet S which has passed through fixing nip NP 1 and whose resistance has been thus increased, and therefore, the surface potentials on the both sides of sheet S are increased. For this reason, it is preferable to increase the value of the voltage to be applied to the both sides of sheet S during the duplex printing in comparison with the case of one-side printing. It is to be noted that the both sides of sheet S are charged in the transferring step and the fixing step regardless of whether the one-side printing or the duplex printing, and therefore, the electric charge on the both sides of sheet S can be sufficiently removed by applying voltages opposite in polarity to the surface potentials of the both sides of sheet S having passed through fixing nip NP, even in the case of the one-side printing.

In addition, in the above-mentioned embodiment, voltage may be applied to the both sides of sheet S for each of sheets S having passed through fixing nip NP. Thus, it is possible to more surely prevent the sheets after the fixing step S from being electrostatically attached to each other. In addition, whether to apply a voltage to the both sides of sheet S may be determined on printing job basis. In this case, when the printing job does not include post processing on printed sheet S, the electrostatic attachment of the sheets after the fixing step is allowable, and therefore, the process of removing the electric charge on the both sides of sheet S is unnecessary. Then, it is possible to prevent the voltage application to the both sides of sheet S from being excessively performed in the case of the printing job including no post processing. Consequently, the electric consumption of high-voltage power supply 90 can be reduced.

In addition, in the above-mentioned embodiment, conveyance roller pair 92 serving as the voltage applying member may be disposed at any position as long as the position is on the downstream side of fixing nip NP in the conveyance direction F of sheet S.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

The invention claimed is:

1. An image forming apparatus comprising:

a fixing side member disposed at a position on a fixing surface side of a sheet on which a toner image is formed;

a back side supporting member that forms a fixing nip for conveying the sheet in a tightly sandwiching manner when the back side supporting member is in pressure contact with the fixing side member; and a voltage applying section that applies to both sides of the sheet passed through the fixing nip voltages opposite in polarity to surface potentials of the both sides, wherein the voltage applying section changes a voltage to be applied to the sheet according to whether one-side printing for forming a toner image on one side of the sheet or duplex printing for forming a toner image on both sides of the sheet is performed.

2. The image forming apparatus according to claim 1 further comprising a surface potential detection section that detects surface potentials of the both sides, wherein the voltage applying section applies a voltage to the sheet so as to cancel out the surface potentials detected by the surface potential detection section.

3. The image forming apparatus according to claim 1, wherein the voltage applying section changes a voltage to be applied to the sheet in accordance with coverage of the toner image formed on the sheet.

4. The image forming apparatus according to claim 3, wherein the voltage applying section increases the value of the voltage to be applied to the sheet as the coverage of the toner image formed on the sheet increases.

5. The image forming apparatus according to claim 1, wherein the voltage applying section changes a voltage to be applied to the sheet in accordance with a resistance of the sheet.

6. The image forming apparatus according to claim 5, wherein the voltage applying section increases the value of the voltage to be applied to the sheet as the resistance of the sheet increases.

7. The image forming apparatus according to claim 1, wherein the voltage applying section changes a voltage to be applied to the sheet in accordance with a basis weight of the sheet.

8. The image forming apparatus according to claim 7, wherein the voltage applying section increases the value of the voltage to be applied to the sheet as the basis weight of the sheet increases.

9. The image forming apparatus according to claim 1, wherein the voltage applying section sets a value of a voltage to be applied to the sheet during the duplex printing to a value larger than a value of a voltage to be applied to the sheet during the one-side printing.

10. The image forming apparatus according to claim 1, wherein the voltage applying section applies to each sheet passed through the fixing nip voltages opposite in polarity to the surface potentials of the both sides.

11. The image forming apparatus according to claim 1, wherein the voltage applying section determines whether to apply voltages opposite in polarity to the surface potentials of the both sides on printing job basis.

12. The image forming apparatus according to claim 1, wherein the voltage applying section applies a voltage to the sheet by making contact with the both sides of the sheet passed through the fixing nip.

13. The image forming apparatus according to claim 1, wherein the voltage applying section applies a voltage to the sheet without making contact with either side of the sheet passed through the fixing nip.

14. The image forming apparatus according to claim 1, wherein the voltage applying section applies voltages to the both sides of the sheet passed through the fixing nip, the voltages applied to the both sides being different from each other in polarity.

15. A fixing device comprising:

a fixing side member disposed at a position on a fixing surface side of a sheet on which a toner image is formed;

a back side supporting member that forms a fixing nip for conveying the sheet in a tightly sandwiching manner when the back side supporting member is in pressure contact with the fixing side member; and a voltage applying section that applies to both sides of the sheet passed through the fixing nip voltages opposite in polarity to surface potentials of the both sides, wherein the voltage applying section changes a voltage to be applied to the sheet according to whether one-side printing for forming a toner image on one side of the sheet or duplex printing for forming a toner image on both sides of the sheet is performed.

* * * * *